United States Patent [19]

Valko, deceased et al.

[11] 4,092,108

[45] May 30, 1978

[54] COMPOSITIONS AND PROCESS FOR IMPARTING DURABLE FLAME RESISTANCE TO CELLULOSIC TEXTILES

[75] Inventors: Emery I. Valko, deceased, late of Belmont, Mass., by Hermina Valko, executrix; Giuliana C. Tesoro, Dobbs Ferry, N.Y.; Walter F. Olds, Arlington, Mass.

[73] Assignee: The United States of America as represented by the Secretary of Agriculture, Washington, D.C.

[21] Appl. No.: 758,312

[22] Filed: Jan. 10, 1977

Related U.S. Application Data

[63] Continuation-in-part of Ser. No. 654,181, Feb. 3, 1976, abandoned.

[51] Int. Cl.[2] ..... D06M 13/26

[52] U.S. Cl. ..... 8/116 P; 8/194; 260/551 P; 260/923; 427/390 D; 427/382; 428/276; 428/277

[58] Field of Search ..... 8/116 P, 194; 427/390 D, 382; 428/276, 277; 260/923, 551 P

[56] References Cited

U.S. PATENT DOCUMENTS

| | | | |
|---|---|---|---|
| 2,929,199 | 3/1960 | Short | 260/551 P |
| 3,107,231 | 10/1963 | Malz | 260/923 |
| 3,712,789 | 1/1973 | Linderman | 8/116 P |
| 3,997,699 | 12/1976 | Sistrunk | 8/116 P |

FOREIGN PATENT DOCUMENTS

| | | | |
|---|---|---|---|
| 4,612,158 | 3/1971 | Japan | 260/923 |

*Primary Examiner*—Paul R. Michl
*Attorney, Agent, or Firm*—M. Howard Silverstein; David G. McConnell

[57] ABSTRACT

Flame resistance is imparted to cellulosic textiles by the application of compositions prepared by reacting phosphonic acid derivatives with ammonia or appropriate amine compounds. Textile compositions thusly obtained exhibit levels of flame resistance which remain essentially unchanged after 50 or more launderings. A comparison of textiles containing the instant compositions to textiles containing prior art flame retardants using verticle flammability tests, reveals that flame resistant textiles of the invention required one half or less of the amount of added compositions to pass the test as did prior art textiles.

7 Claims, No Drawings

COMPOSITIONS AND PROCESS FOR IMPARTING DURABLE FLAME RESISTANCE TO CELLULOSIC TEXTILES

BACKGROUND OF THE INVENTION

This is a continuation-in-part of copending application Ser. No. 654,181, filed Feb. 3, 1976 now abandoned.

This invention relates to organic phosphorus and nitrogen containing compositions and a process for imparting durable flame resistance to cellulosic textiles.

Many compositions and processes have been suggested for decreasing the flammability of cellulosic textiles. Since 1967, interest in such developments has been heightened, and research has been accelerated as a result of legislation and regulatory actions which require certain products to meet stringent standards of flame resistance. Reference is made, for example, to the standard promulgated by the Department of Commerce and known as DOC FF 3-71 which requires garments designated as "children's sleepwear" to be self-extinguishing in the prescribed test even after fifty laundering cycles.

The continuing search for effective durable flame retardant materials and processes has produced a large number of publications and patents on the subject and these have been reviewed in technical articles and books (e.g., Lyons — The Chemistry and Uses of Fire Retardants — Wiley — Interscience — 1970). Careful perusal of the literature reveals that, for textiles manufactured from cellulosic fibers, and particularly cotton, the preferred approach to flame resistance is based on the insolubilization of phosphorus-containing compounds in or on the fibers. Numerous compounds and combinations of compounds have been disclosed, and some have attained commercial significance. For example, some durable flame retardant finishes for cotton fabrics in commercial use today are based on the insolubilization of N-hydroxymethyl-3(dimethyl phosphono)-propionamide representative of the class of compounds covered by U.S. Pat. No. 3,374,292. Others are based on the insolubilization of the organophosphorus compound tetrakis-hydroxymethyl-phosphonium chloride in conjunction with nitrogen-containing coreactants.

Phosphorus and nitrogen are synergistic in flame-retardant finishes for cellulosic fibers; Tesoro et al, Textile Res. J. 38, 245–255 (1968). The use of N-hydroxymethyl dimethyl phosphonopropionamide in conjunction with a triazine resin is an example of a commercially successful finish based on this concept; Aeneshanslin et al, Textile Res. J. 39, 375–381 (1968). Thermochemical studies have indicated that if phosphorus and nitrogen atoms are directly linked, their flame retardant effectiveness might be enhanced; Barker, Textilveredlung 8, 180–186 (1973).

The major shortcoming of known durable flame retardant finishes for cellulosic textiles is the necessity to apply high concentrations of reactants (about 30% to 50% based on the weight of fabric treated) in order to attain the desired level of flame resistance in the treated fabric. When the fabric must meet a vertical flammability test such as that specified in DOC FF 3-71, added solids insolubilized in the fabric after completing the processing may range from a minimum of 16–18% solids in the case of heavy, tightly woven fabrics such as twills to as much as 40% in the case of lightweight, lofty or brushed fabrics such as flannels. The problems posed by such high amounts of added materials are enormous. Aesthetics and performance properties are impaired to varying degrees, sometimes drastically. Since costly chemicals are generally employed, the large amounts required increase the cost of the fabric greatly. Thus, it may be said that with currently available technology, flame resistance can be attained on cellulosic fabrics, particularly cotton, only by sacrificing some desirable attributes of the fabric, and only at considerable cost. Accordingly, there is a great need for compounds and processes which could impart durable flame resistance to cellulosic textiles at lower concentrations of insolubilized flame retardant material than those known in the art. More specifically, there is a need for highly efficient flame retardant compounds which would impart self-extinguishing behavior to treated fabrics in a vertical flammability test (such as specified in DOC FF 3-71) when insolubilized in the fabric in amounts below 20%, and preferably below 10%. The flame resistance should also remain unchanged after 50 laundering cycles. Furthermore, in order for the compounds and processes to be utilized on a large scale in the practical manner at this time, it should be possible to process fabric with these flame retardants from aqueous medium in conventional textile mill equipment:

In accordance with the invention we have discovered a method for imparting durable flame resistance to cellulosic textiles comprising the following steps:

a. reacting 1 part by molecular weight of a first compound having the following formula:

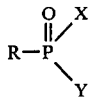

where R is an alkyl or halogen substituted alkyl of from 1 to 4 carbon atoms, X and Y are —OR′ (where R′ is an alkyl or halogen substituted alkyl of from 1 to 4 carbon atoms), bromine, or chlorine, at least one being bromine or chlorine, with from 1 to 6 parts by molecular weight of a second compound having the following formula:

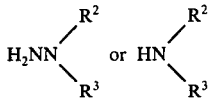

where $R^2$ and $R^3$ are —H, or an alkyl having from 1 to 4 carbon atoms;

b. recovering the reaction products resulting from step (a);

c. absorbing onto a textile containing from 20% to 100% cellulosic fibers an aqueous solution containing the reaction products in amounts such that the subsequently dried, cured, washed, and dried textile products contain from about 5% to about 15% by weight of the reaction products;

d. drying the product resulting from step (c);

e. curing the product resulting from step (d) at a temperature of from 280° to 380° F., for from about 0.5 to 5 minutes; and f. washing and drying the product resulting from step (e).

DETAILED DESCRIPTION OF THE INVENTION

The compositions of the present invention are obtained by reacting a derivative of phosphonic acid of the formula

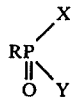

(1)

where R is selected from the group consisting of alkyl and halogen-substituted alkyl of 1 to 4 carbon atoms, X and Y are each selected from the group consisting of —OR′ (where R′ is alkyl or halogen-substituted alkyl of from 1 to 4 carbon atoms) bromine or chlorine, at least one being bromine or chlorine, with a compound of the formula

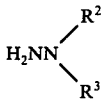

(II)

or

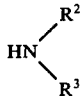

(IIA)

where $R^2$ and $R^3$ are selected from the group consisting of hydrogen and alkyls having from 1 to 4 carbon atoms, in inert reaction medium.

The mole ratio of the phosphonic acid derivative (I) to compound (II) or (IIA) [designated as moles (I)/moles (II)] is between 1/1 and 1/6. The composition and properties of the products obtained depend on the mole ratio employed, on the reaction conditions, and on the method used for purification. The reactions that occur when compounds of formula (I) are added to compounds of formula (II) or (IIA) may be represented by the following illustrative equations:

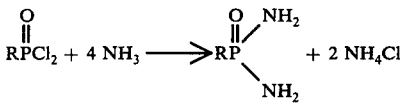

Equation (1)

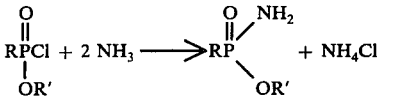

Equation (2)

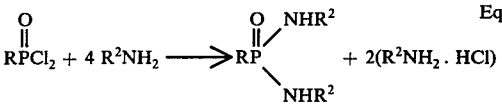

Equation (3)

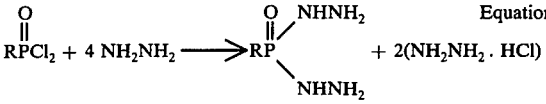

Equation (4)

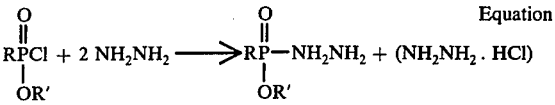

Equation (5)

-continued

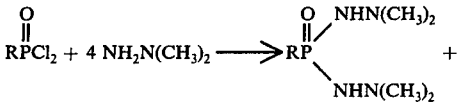

Equation (6)

When compounds of formula (II) (hydrazine and derivatives) are used, and added to a solution of a compound of formula (I) in an inert solvent, more complex products are formed, which may be represented by the illustrative equations designated below as numbers (7) and (8).

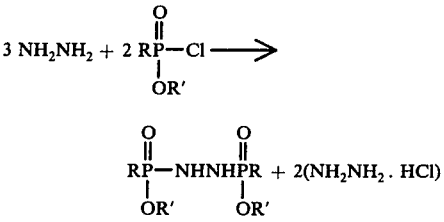

Equation (7)

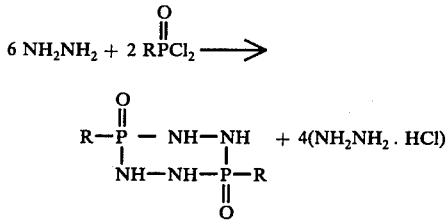

Equation (8)

Thus it is apparent that the reaction products obtained according to equations (1) to (7) may be represented by a generic formula

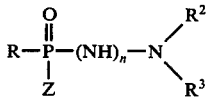

(III)

where Z is selected from the group consisting of OR′ (see formula I) and

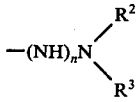

where $n$ is zero or one, and where $R^2$ and $R^3$ are defined as in formula II, but when $n$ is one and Z is OR′, then $R^2$ can also be a group of the formula

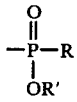

as shown in the product of equation (7).

The cyclic reaction products obtained according to equation (8) and represented by the generic formula (IV) may be obtained when $R^3$ and $R^2$ in the compounds of formula (II) are both hydrogen

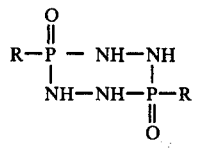

(IV)

The reactions illustrated by equations (1) to (8) are conveniently carried out in an inert organic solvent such as, for example, diethyl ether at temperatures in the range of −20° to +20° C. After removing the solvent, the crude reaction products are obtained as viscous liquids or solids which are difficult to purify and from which by-products such as ammonium chloride, hydrazine hydrochloride, or amine hydrochloride cannot be easily or completely removed. Removal of impurities does not appear critical in the effectiveness of the products when they are applied to fabrics, and crude reaction mixtures give excellent results. The products are readily soluble in water and in common organic solvents.

Among the products shown above, some have been previously disclosed. For example, the reaction products of phosphonic acid dichlorides with ammonia and amines have been tested as flame retardants for cotton fabrics by Morris and Chance, Tex. Res. J. 43, 336 (1973). Use of methylphosphonic diamide as a catalyst to imporve the thermal carbonization of cellulosic fibrous substrates has been claimed (Moore et al, U.S. Pat. No. 3,527,564).

Other, particularly the cyclic compounds obtained by reaction of compounds of formula (I) with hydrazine, are new structures not previously documented in the technical literature. Furthermore, unexpected and surprising results are obtained when the compounds described above, including the new compounds, as well as those known in the art, are applied to cellulosic fabrics in accordance with the invention for the purpose of imparting thereto flame resistance and self-extinguishing behavior durable to laundering, without impairing aesthetics and performance properties in the treated fabrics.

For example, it was reported by Morris and Chance, supra, that amides of chloromethyl phosphonic acid did not yield satisfactory durable flame resistance on 100% cotton fabrics. By contrast, when these compounds are applied to cellulosic fabrics according to the methods of our invention, the treated fabrics are self-extinguishing even after fifty home launderings, and their handle and performance properties are satisfactory.

The specific features which distinguish the processes of the present invention from those known in the art are discussed briefly below.

Compounds/Reagents: Compounds of this invention are small, reactive molecules of high phosphorus content and low carbon content. They have low vapor pressure, high water solubility, and adequate hydrolytic stability in use. In short, they fulfill most of the requirements which have been listed or documented for "ideal flame retardant finishing agents" for cotton. The fact that the compounds can be dissolved in water, applied and reacted without purification provides an added advantage.

Fabric processing: The insolubilization of the compounds is carried out by a conventional procedure in which the fabric is padded or otherwise impregnated with the aqueous solutions of the products, dried, cured to insolubilize the flame retardant, and washed to remove soluble residues. The concentration of the aqueous solution applied depends on the particular compound used on the fabric being treated, on the amount of liquid absorbed by the fabric in padding, and on the required level of flame resistance. Surprisingly, concentrations of product ranging from about 10% to 20% are satisfactory for most fabrics.

The add-on may be from 1 to 30 weight percent, more preferably from about 5 to about 15 weight percent. The amount of add-on should be sufficient to give at least about 1.5 to 4 weight percent phosphorous on the fabric or other fibrous material to be treated. The nature of the solvent is not critical. Most preferably water is employed, but lower alkanols such as methanol and ethanol are considered to be equivalent to water for use in this invention.

Drying conditions are not critical. Curing times of from 0.5 to 5 minutes and curing temperatures of from 280° to 380° F are required. The yield obtained in the reaction with cellulose (insolubilization efficiency) can be calculated from the amount of phosphorus retained in the fabric after the process wash. The yield in some instances approaches 100%, even though optimum treatment conditions vary from compound to compound and must be determined by trial and error.

In the preferred embodiment of the present invention, the aqueous solution of the flame retardant compounds contains an additive which further improves the results obtained in the process with respect to appearance (preserving whiteness in the case of white fabrics), efficiency of insolubilization of the added phosphorus, and performance properties of the treated fabrics. The mechanism by which the additives produce such extraordinary improvements is not fully understood and several classes of additives have varying degrees of effectiveness. The preferred additive depends on the specific compound applied and on other factors, but excellent results have been obtained with the following:

(A) Inorganic bases which neutralize the ammonium chloride which may be present in the crude reagent; the amount of base used should be controlled to obtain a pH of about 10.0–12 in the treating solution;

(B) Formaldehyde, used in amounts of about 0.2% to 3.0% based on the weight of treating solution;

(C) Polyfunctional N-methylol compounds such as dimethylol ethylene urea,

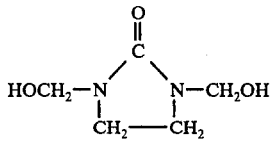

N,N-dimethylol methyl carbamate,

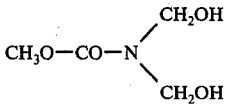

and the like, used in amounts of about 0.5% to 5%, based on the weight of treating solution;

(D) N-methylol dialkyl-phosphonopropionamides such as

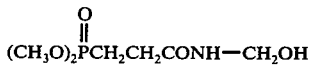

and the like, used in amounts of about 0.5% to 5%, based on the weight of solution.

Other additives which may be effective can be identified by trial and error. The above are intended as illustratives of compounds that have produced significant and unexpected improvements in the processes of our invention.

A particularly important feature of the present invention is the discovery that the compounds represented by generic formula (III) are effective modifiers for cellulosic substrates, and introduce covalently bound phosphorus into the cellulose molecule, providing that appropriate conditions of curing for the specific reagent are used. Significant deviations from the best range of curing conditions result in lowered yields of insolubilized phosphorus in excessive discoloration, and/or in decreased durability of flame resistance after repeated laundering. Specific conditions for reaction occurring should be determined for each reagent by trial and error, but certain generalizations can be formulated for optimum utilization of the compounds covered by this invention as flame retardants for cellulosic fabrics.

(A) High curing temperature of from about 280° to 380° F. and short curing times (e.g., 0.5 to 5 minutes) are far more effective than longer times at lower temperature. This unexpected finding is in marked contrast to processes known in the art, and constitutes a critical distinction between the processes described herein and those previously reported. However, heating times of from several seconds to as long as one hour can be used.

(B) Compounds in which the group R is methyl are exceptionally effective and efficient flame retardants. Surprisingly, they consistently yield better results than those in which R is chloromethyl or higher alkyl (e.g., propyl). The advantage of R = methyl over R = chloromethyl is particularly surprising since the presence of chlorine would be expected to contribute to flame retardant effectiveness.

(C) The reactivity of the compounds is enhanced, and the properties of treated fabrics are improved when the treating solution contains certain additional ingredients which are inert with regard to flame retardant effect. Generally speaking, results obtained with relatively pure compounds are inferior to those obtained in the presence of additives. This finding is unexpected, and as yet not understood, particularly because the additives include different classes of chemical compounds where effects might range from catalysis of cellulose reaction (as in the case of ammonium salts, amine salts, or other acid-forming compounds) to buffering and neutralization of acidic groups (as in the case of inorganic base) to competitive reactions with the substrate (as in the case of formaldehyde and N-methyl compounds).

The course of the insolubilization reaction caused by curing is not fully understood. It is postulated that several different cellulose derivatives may be formed in each case, including, for example, crosslinked cellulose phosphonates;

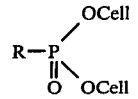

cellulose amidates or hydrazidates:

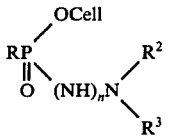

where $R^2$ and $R^3$ are hydrogen or alkyl of 1 to 4 carbon atoms, and $n$ is zero or one; and other phosphorus-containing cellulose derivatives, some among them also containing nitrogen.

The application conditions described are consistent with application conditions recommended for other finishes (e.g., durable press) on cellulosic fabrics, and combinations of the novel flame retardants with other functional finishes are within the scope of the present invention.

In the examples, infra, the ratio of fixed nitrogen to phosphorus was found to be less than half the ratio of these atoms in the original reactant. This means that either extensive hydrolysis or diester formation occurred. Cation exchange properties exhibited by the treated fabric suggest that the first reaction, acid ester formation prevailed. Nevertheless, the effect of hard water was less than with phosphorylated cotton, probably because the acid phosphonates have only half the cation exchange capacity of the monoester phosphates and their affinity for calcium ions is therefore lower.

Good yields of insolubilized phosphorus were obtained with a 1 to 2 minute cure at 350° C. With diamide hydrazides, yields approach 100 percent when less than 3 percent phosphorus is needed on the weight of the fabric. Applications of higher concentrations of the reagent resulted in reduced yields. It appears that it is not possible to fix a larger amount of reactant than that corresponding to about 4 percent P on the weight of cotton. This limit corresponds roughly to one substituent for each accessible glycopyranose unit (assuming 20 percent accessibility). The low yields (45 percent) for chloromethylphosphonic diamide reported in the literature might have been due, at least partially, to the high concentrations of reagent applied. It was found that from about 1.5 to about 4 percent phosphorus, depending on fabric type, was required to pass DDOC FF 3-71. Therefore, the limited capacity for phosphonation does not present a problem. Combination with reactive melamine compounds would offer a solution if higher levels of flame resistance are required.

The amidate and hydrazidate ($R_3$ is $OCH_3$ or $OC_2H_5$) are less reactive than the diamide and dihydrazide and they could only be fixed in low yields, but at the same level of retained phosphorus their flame retardant effect was equal to that of reagents in which $R_3$ is $NH_2$ or $NHNH_2$.

Although the processes of this invention are primarily designed for the treatment of 100% cotton fabrics, or of fabrics containing significant amounts of cotton, they are generally useful for fabrics containing cellulosic fibers, including blends of cotton with polyester or other synthetic fibers in which the cotton content may range from 80% to 20%, and including fabrics made from regenerated cellulose fibers such as viscose rayon, either entirely or in blends with other fibers. Fabrics made from blends or mixtures of cotton fibers and regenerated cellulose fibers, which are commonly used for draperies and upholstery fabrics can also be advantageously treated according to the processes described in the present invention.

MATERIALS AND METHODS USED IN EXAMPLES

A. Fabrics

1. Bleached and mercerized 80 × 80 cotton print cloth (3.4 oz/sq yd) Testfabrics Inc. S/400 WM
2. Bleached and mercerized cotton twill (8oz/sq yd)
3. Khaki dyed cotton twill (8 oz/sq yd)
4. Printed cotton flannelette (3.5 oz/sq yd)

B. Test Methods

| | | | |
|---|---|---|---|
| 1. Stiffness | ASTM | D-1388-64 | Cantilever Bending |
| 2. Tensile Strength | ASTM | D-1682-64 | Ravelled Strips |
| 3. Tear Strength | ASTM | D-1424-63 | Elmendorf |
| 4. Crease Recovery | ASTM | D-1295-67 | Monsanto |
| 5. Flammability | | | |

a. U.S. Department of Commerce Standard DOC FF 3-71
b. Limiting oxygen index (LOI) Method. [Textile Res. J. 40, 204 (1970)]
c. Angular flame test (AFT) Method. [Textile Res. J. 40, 225 (1970)]

6. Laundering AATCC Method 124-1969, Washing Procedure 6.2 (III) with Sears Kenmore 70 automatic washer C. Analytical Methods: Quantitative Organic Microanalysis, 2nd Edition, by Al Steyermark, Academic Press, 1961.

1. Phosphorus as phosphomolybdate, pp 357–359.
2. Nitrogen by Kyeldahl method, pp 188–190.
3. Chlorine and chloride by burning in an oxygen flash, or oxygen bomb for very small amounts, and titrating with a Fisher Titralyzer or Catlove Titrator, pp 332–333.

EXAMPLES

A. Dihydrazides

EXAMPLE 1

Chloromethylphosphonic Dihydrazides $$ClCH_2\overset{O}{\overset{\|}{P}}(NHNH_2)_2$$

A solution of one mole of chloromethylphosphonic dichloride (Stauffer Chemical) in 1 lb. of anhydrous ether was added dropwise to a stirred suspension of four moles of hydrazine in 1 lb. of anhydrous ether at 0° to 10° C. The gummy mixture of dihydrazide and hydrazine hydrochloride was insoluble in the ether which was decanted after the addition.

The reaction products formed by adding a solution of one mole of chloromethylphosphonic dichloride (CMPDC) to a suspension of four moles of hydrazine should consist of 54% chloromethylphosphonic dihydrazide and 46% hydrazine hydrochloride, but the components could not be separated. However, the crude mixture is quite stable on storage and it is water soluble. (The activity of the aqueous solution decreased about 6.0% in one hour at 70° F.). A yield of 64% of the applied phosphorus was obtained on twill by the usual pad-dry-cure method:

An 8 oz. cotton twill was padded in a solution of 51 g. of crude reaction product solid mixture in 36 g. of water and squeezed through a roller to obtain an 85% wet add-on. The fabric was dried and cured at 350° F. for 3 minutes and laundered in an automatic washer at 140° F. with TIDE detergent. The finished twill had a 14% add-on and contained 3.2% P, 1.8% N, and 0.05% Cl. The char length was 2 inches (DOC-FF 3-71 test). The fabric was very slightly discolored by this treatment. The hand was excellent.

Remarkably, the char length of the fabric increased to only 3 inches after 5 additional launderings with hypochloride bleach and TIDE at 140° F.

EXAMPLE 2

Propylphosphonic dihydrazide $$C_3H_7\overset{O}{\overset{\|}{P}}(NHNH_2)_2$$

Propylphosphonic dihydrazide (PPDH) was prepared by slowly adding a solution of 60 g. of propylphosphonic dichloride in 450 g. of ether to a stirred suspension of 64 ml. of hydrazine in 450 g. of ether at 0° C.

The mixed products were insoluble in ether. The dihydrazide could not be separated from the hydrazine HCl by extraction (dioxane, diethoxyethane, nitromethane, or chloroform). The mixed solids were totally soluble in water and the solution was applied to two samples of 8 oz. cotton twill which were then treated as in Example 1. The results are shown below:

| Expt. No. | Laundered Cotton Properties % Add-on | °AFT[a] | "CL[b] | % Yield of P on Fabric | Fabric %P | %N |
|---|---|---|---|---|---|---|
| 69-1 | 12 | 180 | 3.3 | 48 | 2.5 | 0.5 |
| 69-2 | 10 | 135 | 7.0 | 40 | 2.0 | — |

[a]Degrees Angular Flame Test. Untreated cotton twill burns at 0°, a value of 135° indicates good flame resistance and 180° indicates excellent flame resistance.
[b]Department of Commerce FF 3-71 flame test. "CL - char length in inches.

Fabric 69-2 was laundered 50 times with AATCC 124 detergent at 140° F. and the %P and char length were unchanged. The fabric was slightly darkened by repeated laundering, but could be bleached with oxygen bleach to its original whiteness.

When 33 g. of crude solid mixture was stirred with 220 ml. of absolute ethanol at 70° F. for 2 hours, 17 g. of viscous liquid containing 15.8% P, 30.9% N, 6.3% Cl was obtained by concentrating the extract at 70° F./0.1 mm. This product is partially purified PPDH. It was insolubilized on twill in 36% yield and a 12% add-on provided good fire resistance.

EXAMPLE 3

Methylphosphonic Dihydrazide $$CH_3\overset{O}{\overset{\|}{P}}(NHNH_2)_2$$

A solution of 128 g. methylphosphonic dichloride (MPDC) in 450 g. anhydrous ether was added dropwise to a stirred suspension of 128 ml. anhydrous hydrazine in anhydrous ether at 0° C. After the addition, the reaction was allowed to warm up to 70° F. and the ether was decanted from the 261 g. of crude, solid mixture of the dihydrazide and hydrazine hydrochloride.

Two samples of 8 oz. cotton twill were padded in a 17% solution of the crude mixed solids, squeezed to an 85% wet add-on dried at 210° F. for 10 minutes, and cured at 350° F. as follows:

| Expt. No. | Min. at 350° F. | Laundered % Yield | Laundered Fabric Properties %P | %N | %Add-on | "CL | LOI |
|---|---|---|---|---|---|---|---|
| 91-5 | 1 | 100 | 1.9 | 0.3 | 8 | 2 | — |
| 91-6 | 2 | 95 | 1.8 | 0.2 | 5 | 5 | .25 |

Fabric 91-5 was laundered fifty times with AATCC 124 detergent at 140° F. The limiting oxygen index was then 0.25 and the phosphorus content and "CL were unchanged.

Two samples of 100% cotton printed flannelette (commercially available fabric) was padded in a 35% solution of the crude mixed solids, squeezed to a 107% wet add-on, dried at 220° F. for 10 minutes, and cured at 350° F. to yield treated samples as shown below.

| Expt. No. | Min. at 350° F. | Laundered % Yield | Laundered Fabric Properties %P | %N | %Add-on | "CL | LOI |
|---|---|---|---|---|---|---|---|
| 93-1 | 1 | 74 | 2.8 | 0.3 | 13 | 3.4 | .26 |
| 93-2 | 2 | 67 | 2.5 | 0.2 | 12 | 4.0 | .26 |

The effect of this treatment on the appearance and performance properties of the fabric was negligible. The hand of treated flannelette was as soft as that of untreated material as shown by Cantilever bending moments of 8.8 and 7.2 for 93-1 and 93-2 vs. 10.4 for untreated flannelette in the fill direction.

Swatches of 3.4 oz. 80 × 80 cotton print cloth were padded in 30 or 45% solutions of the crude mixed solids to a 107% wet add-on, dried at 210° F. for 3 minutes and cured at 350° F. for 4 minutes with the following results:

| Expt. No. | Fill Tear[1] Strength (lbs.) | Fill Tensile[1] Strength (lbs.) | Dry Wrinkle[1] Recovery (W+F) | Fill Bending[1] Moment (cm) |
|---|---|---|---|---|
| Control | 1.0 | 38.5 | 124 | 9.5 |
| 106-3 | 0.6 | — | 124 | 8.9 |
| 106-4 | 0.7 | 24.9 | 141 | 9.7 |

[1]See pH, Test Methods

B. Cyclic or Linear Hydrazide Polymers

EXAMPLE 4

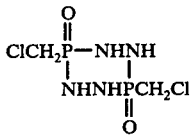

Hexahydro-3,6-di-(chloromethyl)-1,2,4,5,3,6-tetra aza disphosphorine-3,6-dioxide.

This compound was formed by slowly adding 3 moles of hydrazine to a stirred solution of 1 m. chloromethylphosphonic dichloride dissolved in anhydrous ether (450 g.) at 0° C. A quantitative yield of crude product and hydrazine hydrochloride was obtained by decanting the ether. The crude solid mixture was dissolved in water, applied to 5 samples of 8 oz. cotton twill, which was squeezed to an 85% wet add-on.

The following data were obtained after drying at 210° F. for 10 minutes and curing at 350° F. as follows:

| Expt. No. | Bath Con(%) Crude | Min. at 350° F. | Laundered Fabric Properties % Add-on | °AFT | "CL | % Yield of Active Weight Applied |
|---|---|---|---|---|---|---|
| 85-3 | 60 | 1 | 8 | 135 | BEL[a] | 34 |
| 85-4 | 60 | 2 | 12 | 180 | 1.6 | 50 |
| 85-1 | 60 | 3 | 15 | 180 | 1.0 | 60 |
| 85-2 | 60 | 6 | 15 | 180 | — | 60 |
| | | | | 180 | 4.5 | 86 |

[a]BEL burned entire length

EXAMPLE 5

Hexahydro-3,6-dipropyl-1,2,4,5,3,6-tetra aza diphosphorine-3,6-dioxide

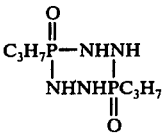

This compound was formed by slowly adding 3 moles of hydrazine to 1 mole of propylphosphonic dichloride in 1 lb. of anhydrous ether stirred at 0° C. After the addition was complete, the reaction was allowed to warm up to room temperature and the ether was decanted from the mixed solid products.

An 8 oz. cotton twill was padded in an aqueous solution containing 50% crude mixed solids (pH 7.5) to an 85% wet add-on. The fabric was dried at 210° F. for 10 minutes and cured at 350° F. for 3 minutes. After laundering with AATCC 124 detergent, the add-on was 15% (a 76% yield based on the active compound in the mixture), the char length was 3 inches in the DOC FF 3-71 flame test, and the limiting oxygen index was 0.26 (untreated was 0.17).

Thirty grams of the crude was extracted with 180 ml. of absolute ethanol and 18 g. of viscous liquid was obtained by concentrating the extract at 70° F. / 0. 1mm.

| | %P | %N | %Cl |
|---|---|---|---|
| Theory for $C_6H_{18}P_2N_4O_2$ | 26.6 | 23.2 | 0.0 |
| Found | 15.4 | 27.8 | 5.9 |

This partially purified material was padded on twill and a 78% yield was obtained. A 13% add-on provided a 4 inch char length and a 0.25 limiting oxygen index.

EXAMPLE 6

Hexahydro-3,6-dimethyl-1,2,4,5,3,6-tetra aza diphosphorine-3,6-dioxide

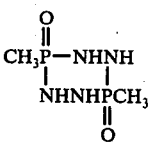

This compound was formed by adding 97 ml. of anhydrous hydrazine dropwise to a stirred solution of 128 g. methylphosphonic dichloride in 2 lbs. anhydrous ether at 0° C. The reaction mixture was allowed to warm to room temperature and the ether was filtered from 220 g. solid product mixture.

An 8 oz. cotton twill was padded in a 30% solution of this mixture, squeezed to an 85% wet add-on, dried at 210° F. for 5 minutes, and cured at 350° F. A 2 minute cure provided a 100% yield on fabric after laundering, based on the weight of active material applied. An 11% add-on provided a 1 inch char length in the DOC FF 3-71 flame test. The effect on other properties of the fabric was minimal.

C. Hydrazidates

EXAMPLE 7

Ethyl chloromethylphosphonic hydrazidate $$ClCH_2P(O)(OEt)NHNH_2$$

We prepared this hydrazidate by slowly adding ethyl chloromethylphosphono chloridate (45 g., 0.25 mole) in 1 lb. of anhydrous ether to hydrazine (16 g., 0.50 mole) suspended in 1 lb. of anhydrous ether stirred at 0° C. The solid which formed was filtered off and the crude solid was extracted with anhydrous ethanol which was evaporated to yield 35 g. (80% theory) of purified solid, mp 120°–123° C.

| Analyses for hydrazidate: | %C | %H | %Cl | %P | %N |
|---|---|---|---|---|---|
| Theory: | 20.7 | 5.76 | 21.0 | 18.4 | 16.1 |
| Found: | 21.4 | 5.30 | 21.0 | 18.5 | 11.3 |

An 8 oz. cotton twill was padded in a 50% aqueous solution of this solid and dried. A 15 minute cure at 320° F. provided a 40% yield on the fabric after laundering. A 15% add-on provided a 1.4 inch char length in the FF 3-71 flame test.

Ethyl chloromethylphosphono chloridate was prepared by slowly adding a solution of 116 ml. anhydrous ethanol (92 g., 20 moles) in 284 ml. triethylamine (427 g., 2.1 moles) to a stirred solution of 205 ml. of chloromethylphosphonic dichloride (335 g., 2.0 moles) in 3 lbs. anhydrous ether at 10° C. The reaction stood at 25° C. overnight and the solid TEA-HCl was separated by vacuum filtration. The filtrate was stripped of ether and the product distilled at 67° C./0.7 mm. to yield 227 g. (64%) with an index $n_D^{26}$ 1.4604 (Lit. $n_d^{20}$ 1.6463); density 1.36 g./ml. This product was used to make the ester hydrazidate.

EXAMPLE 8

Methyl methylphosphono hydrazidate (MMPH)

$$CH_3P(O)(OCH_3)NHNH_2$$

The methyl methylphosphono chloridate was prepared by adding a solution of 1 mole of anhydrous methanol in 1.1 moles of anhydrous triethylamine slowly to a well stirred solution of 1 mole of MPDC in 1 lb. of anhydrous ether at OC, filtering and distilling. We obtained a 47% yield, bp 45° C./1 mm., $n_D^{20}$ 1.4395.

MMPH was prepared by adding a solution of 1 mole of the chloridate in benzene to 2 moles of hydrazine suspended in benzene at 10° C. and stirred. The solid mixed products were extracted with cold ethanol and a solid (mp 85° C.) was obtained:

| | %C | %H | %P | %N |
|---|---|---|---|---|
| Theory MMPH | 19.4 | 7.25 | 25.0 | 22.6 |
| Found | 17.2 | 7.54 | 22.0 | 24.8 |

Theory for MMPH containing 10% hydrazine hydrochloride is:

| | | | | |
|---|---|---|---|---|
| | 17.6 | 7.30 | 22.7 | 25.2 |

MMPH was applied to 8 oz. cotton twill as shown in the table. An 8% add-on was required for a 5 inch char length and the yield on fabric was 50%. The treated fabric contained 1.9% P and 0.2% N (141-2).

MMPH ON COTTON TWILL

| Expt. No. | Min. at 350° F. | Properties of Fabric Laundered Once %Yield | %Add-on | °AFT | "CL | %P | %N |
|---|---|---|---|---|---|---|---|
| 140-1 | 3 | 50 | 10.9 | 180 | 2.0 | — | — |
| 140-2 | 6 | 48 | 10.5 | 180 | — | 2.1 | 0.2 |
| 141-2 | 3 | 44 | 7.5 | 135 | 5.0 | 1.9 | 0.2 |
| 141-3 | 6 | 43 | 7.3 | 135 | — | — | — |

EXAMPLE 9

Ethyl methylphosphono hydrazidate (EMPH)

$$CH_3P(O)(OC_2H_5)NHNH_2$$

This hydrazidate was prepared from the ethyl methylphosphono chloridate (EMPC) which was prepared by adding a solution of 1 mole of absolute ethanol in 1.1 moles of triethylamine dropwise to a stirred solution of 1 mole of methylphosphonic dichloride in 1 lb. of anhydrous ether at 0° C:

$$CH_3P(O)Cl_2 + C_2H_5OH + TEA \longrightarrow CH_3P(O)(OC_2H_5)Cl + TEA \cdot HCl$$

The product (90G., 64% yield) distilled at 33° C/0.3 mm., $n_D^{24}$ 1.4310 (Lit. 28° C/0.06 mm, $n_D^{20}$ 1.4344, 75% yield).

This chloridate (0.64 mole) was added dropwise over a period of 3 hours to a stirred suspension of 1.28 moles of hydrazine in 1 liter anhydrous benzene at 20° C:

$$CH_3P(O)(OC_2H_5)Cl + 2NH_2NH_2 \longrightarrow CH_3P(O)(COC_2H_5)N_2H_3 + NH_2NH_2 \cdot HCl$$

The EMPH is sparingly soluble in benzene and the hydrazine hydrochloride was removed by filtration. After evaporation of the benzene at 32° C./20 mm., the analytical values of the residue were:

| | % P | % N | % C | % H |
|---|---|---|---|---|
| EMPH Theory: | 22.4 | 20.3 | 26.0 | 7.96 |

-continued

| | % P | % N | % C | % H |
|---|---|---|---|---|
| Found: | 21.6 | 20.0 | 25.3 | 8.08 |

A 21% solution of purified EMPH was applied to 423 cotton twill (100% cotton, 8 oz./sq. yd., bleached and mercerized) and cured at 350° F., both with and without added hydrazine hydrochloride as a catalyst. The results are summarized in the table below.

EFFECT OF HYDRAZINE HYDROCHLORIDE ON YIELD OF EMPH ON 8 OZ. COTTON TWILL

| EMPH Expt. | % $N_2H_4 . HCl$ Added[a] | Min. at 350° F. | % Yield | % Add-on | "CL |
|---|---|---|---|---|---|
| 110-2 | 0 | 2 | 0 | 0 | — |
| 125-1 | 2 | 6 | 14 | 3.0 | — |
| 125-2 | 10 | 6 | 20 | 4.3 | BEL |
| 110-3 | 50 | 2 | 14 | 2.9 | BEL |
| 110-4 | 50 | 6 | 29 | 6.2 | 6.5 |
| 125-3 | 50 | 6 | 31 | 6.6 | 4.0 |

[a]On the weight of EMPH

Other catalysts were also tried at 5% concentration in the 21% EMPH bath with the results shown in the table below, which demonstrate effective use of zinc nitrate.

EFFECT OF VARIOUS CATALYSTS ON YIELD OF EMPH ON 8 OZ. COTTON TWILL

| EMPH Expt. | % $N_2H_4 . HCl$ Added | Min. at 350° F. | % Yield | % Add-on | "CL |
|---|---|---|---|---|---|
| | 5 Percent | | | | |
| 131-1 | $Zn(NO_3)_2$ | 6 | 34 | 7.2 | 6.0 |
| 131-4 | $NH_4Cl$ | 6 | 23 | 4.9 | BEL |

D. Diamides

EXAMPLE 10

Chloromethylphosphonic diamide (CMPDA)

$$ClCH_2\overset{O}{\overset{\|}{P}}(NH_2)_2$$

We prepared CMPDA according to British Pat. No. 1,126,259 (1968) by adding a solution of 1 mole of chloromethylphosphonic dichloride (167 g.; 100 ml.) in 500 ml. of methylene chloride dropwise to a solution of 5 moles of liquid ammonia (85 g.; 120 ml.) in 2 liters of methylene chloride stirred at −40° C. The crystalline mixture of CMPDA and $NH_4Cl$ was warmed at 20° C., collected quickly on a Buchner funnel and dried under vacuum at 40° C. to a constant weight. The yield was 223 grams (95%) of which 55% was CMPDA and 45% was $NH_4Cl$. This mixture was applied to twill without attempting to separate the $NH_4Cl$ from the CMPDA.

Testfabrics Inc., 423 cotton twill was padded with a 23.6% solution of the crystalline mixture (12.9% CMPDA and 10.7% $NH_4Cl$) at pH 6.6, and with a similar solution to which NaOH had been added to bring the pH to 10.4. The wet pickup was 85% and 10.9% CMPDA was therefore applied to the fabric which was dried at 220° F. for 5 minutes and then cured at 350° F. for 2 and 5 minutes. The results are compared with experiments done at 320° F. in the tables below. A 100% yield was obtained by a 2 minute cure at 350° F. when the pad bath was at pH 6.6. Only a 32% yield was obtained with a similar bath by a 15 minute cure at 320° F. (2-136). Other investigators also obtained a 30% yield with pure CMPDA cured at 320° F. for 5 and 15 minutes, Morris and Chance, supra, and British Pat. No. 1,126,259, see A and B on Table below.

CMPDA ON 8 OZ. COTTON TWILL AT 350° F. VS. 320° F.

| CMPDA Expt. | % in Bath | Bath pH | % Net Pickup | % Add-on Wt. | % Add-on P | Min. at 350° F | Laundered Avg. "CL %P | Laundered Avg. "CL Once | Laundered Avg. "CL 25 × | % Yield |
|---|---|---|---|---|---|---|---|---|---|---|
| 27-2 | 13 | 10.4 | 85 | 11 | 2.7 | 2 | 2.1 | 5.3 | 7.8 | 77 |
| 27-4 | 13 | 10.4 | 85 | 11 | 2.7 | 5 | 2.7 | 1.5 | 4.3 | 100 |
| 29-1 | 13 | 6.6 | 85 | 11 | 2.7 | 1 | — | BEL | — | 48 |
| 29-4 | 13 | 6.6 | 85 | 11 | 2.7 | 2 | — | 2.2 | — | 100 |
| | | | | | | 320° F | | | | |
| A | 44 | 7 | 100 | 44 | 10.6 | 5 | 3.1 | 4.2 | — | 29 |
| B | 30 | 7 | 150 | 45 | 10.8 | 15 | 3.2 | 4.8 | — | 30 |
| 2-136 | 30 | 6.6 | 85 | 25 | 6.0 | 15 | 2.0 | 3.7 | — | 32 |

INDIVIDUAL CHAR LENGTH VALUES OF 8 OZ. COTTON TWILL TREATED WITH CMPDA

| CMPDA Expt. | % Add-on Wt. | % Add-on P | Laundered Once, AATCC Det. "CL | | | | Avg. | Laundered 25× in AATCC Det. "CL | | | | Avg. |
|---|---|---|---|---|---|---|---|---|---|---|---|---|
| 27-2 | 8.5 | 2.1 | 1.2 | 2.6 | 8.6 | 8.8 | 5.3 | 5.9 | 6.8 | 8.3 | 10.0 | 7.8 |
| 27-4 | 11 | 2.7 | 1.3 | 1.4 | 1.5 | 1.7 | 1.5 | 3.1 | 3.7 | 5.0 | 5.5 | 4.3 |
| 29-1 | 5.2 | — | BEL | — | — | — | BEL | — | — | — | — | — |
| 29-4 | 11 | — | 1.3 | 1.4 | 3.0 | 3.1 | 2.2 | — | — | — | — | — |

EXAMPLE 11

Methylphosphonic diamide (MPDA)

$$CH_3\overset{O}{\overset{\|}{P}}(NH_2)_2$$

Following Ratz, J. Am. Chem. Soc., 77 1470–1471 (1959), a crystalline mixture of MPDA and $NH_4Cl$ was prepared by adding a solution of 2 moles of methylphosphonic dichloride (266 g.; 188 ml.) in 800 ml of chloroform dropwise to a stirred solution of 8 moles (100% excess) of liquid ammonia (136 g.; 190 ml.) in 800 ml of chloroform at −50° C. After the addition was complete, the stirred mixture was slowly heated to reflux for 1 hour. After it cooled to room temperature, the precipitated crystalline mixture was collected rapidly on a Buchner funnel and dried under vacuum at 40° C. to a constant weight. The yield was 384 g. (95%) of which 47% was MPDA and 53% $NH_4Cl$.

Testfabrics, Inc. S/423 8 oz. white 100% cotton twill was padded in a 20% solution of the crystalline mixture (pH6; 9.4% MPDA and 10.6% $NH_4Cl$) to an 85% wet pick-up (8.0% MPDA applied owf). This solution could be adjusted to pH 11 by adding sodium hydroxide, and the cured fabric had better appearance without effect on the add-on. After drying at 220° F. for 5 minutes, the fabric was cured at 350° F. for 1, 2, or 3 minutes and laundered once with AATCC detergent. The add-on, apparent yield, and char lengths are shown in the following Table.

MPDA ON 8 OZ. COTTON TWILL LAUNDERED ONCE (85% Wet Pickup of 9.4% MPDA in Bath)

| Bath pH | Min. at 350° F | Laundered Apparent Wt.%[a] Add-on | Yield | Cl 1 | 2 | 3 | 4 | Avg. |
|---|---|---|---|---|---|---|---|---|
| 6.0 | 1 | 5.9 | 74 | 4.6 | 4.6 | 5.6 | 6.9 | 5.4 |
| | 2 | 7.6 | 95 | 2.0 | 3.2 | 3.5 | 3.6 | 3.1 |
| | 3 | 6.4 | 80 | 1.2 | 1.3 | 1.5 | 5.1 | 2.3 |
| 9.7[b] | 1 | 4.7 | 59 | 9.2 | 9.6 | 10.2 | BEL | 9.6 |
| | 2 | 7.9 | 99 | 1.2 | 1.3 | 1.3 | 1.3 | 1.3 |
| 9.8[c] | 1 | 4.9 | 61 | BEL | BEL | BEL | BEL | BEL |
| | 3 | 8.0 | 100 | 1.2 | 1.2 | 1.0 | 1.0 | 1.1 |
| 10.4[d] | 2 | 7.4 | 93[d] | 1.3 | 1.6 | 1.8 | 1.9 | 1.7 |
| | 3 | 7.2 | 90 | 0.9 | 1.7 | 1.7 | 2.4 | 1.7 |
| 11.0[e] | 1 | 4.8 | 60 | BEL | BEL | BEL | BEL | BEL |
| | 2 | 7.9 | 99 | 0.9 | 1.3 | 1.5 | 1.6 | 1.3 |

[a]The moisture regain increase due to the treatment make the apparent weight yields shown approximate values.
[b]1.2 equivalents $Na_2CO_3$ per $NH_4Cl$.
[c]0.5 equivalents NaOH per $NH_4Cl$.
[d]0.9 equivalents NaOH per $NH_4Cl$. (The yield of applied P is 83%.)
[e]1.0 equivalents NaOH per $NH_4Cl$.

The process was repeated with the following results:

| MDPA Applied % owf | Min. at 350° F | Laundered Apparent WT % P | Yield of P Fixation | "Cl LAUNDERED Once | 50 Times |
|---|---|---|---|---|---|
| 8 | 2 | 2.0 | 88 | 1.7 | 6.6 |
| 9.5 | 3 | 2.7 | 93 | 2.0 | 2.5 |

EXAMPLE 12.

Methyl phosphonic diamide (MPDA) with additives

The addition of little methylol co-reactant, or formaldehyde, to the MPDA solution produced a whiter fabric with good flame retardant properties, as shown in the experiments summarized below.

Effect of Methylol Co-reactant With MPDA 20% Crude (9.4% Pure) MPDA at 80% WPU on 423 Testfabrics Twill at 350° F/2 minutes

| Expt. No. | % Bath Additive | Bath pH | Rinsed pH | Apparent Wt. % Add-on | Yield | % Light Reflected | "CL Avg. Tests |
|---|---|---|---|---|---|---|---|
| Twill as received, or after one laundering, had a reflectance of 82% | | | | | | | |
| 16-1 | None | 6.3 | 3.3 | 8.1 | 108 | 52 | 4.3 |
| 144-2 | 8% NaOH | 11.8 | 5.0 | 7.0 | 85 | 69 | 2.1 |
| 16-4 | 2% Urea | 5.9 | 3.4 | 9.0 | 120 | 66 | 5.3 |
| 16-2 | 1% DMMC[a] | 6.0 | 3.3 | 8.2 | 99 | 70 | 2.3 |
| 16-3 | 3% DMMC | 6.0 | 3.3 | 7.7 | 78 | 68 | 9.1 |
| 17-3 | 1% DMEU[b] | 6.3 | 3.3 | 8.0 | 96 | 69 | 6.4 |
| 17-4 | 3% DMEU | 6.3 | 3.4 | 8.7 | 88 | 72 | 4.5 |
| 17-5 | 1% Pyrovatex[c] | 5.8 | 3.3 | 10.2 | 123 | 68 | 2.6 |
| 17-6 | 3% Pyrovatex | 5.7 | 2.8 | 10.5 | 106 | 68 | 3.5 |
| 18-4 | 0.3% HCHO | 6.4 | 3.3 | 8.4 | 110 | 65 | 5.4 |
| 18-3 | 0.5% HCHO | 6.4 | 3.3 | 8.2 | 103 | 74 | 2.9 |
| 18-1 | 1.0% HCHO | 6.0 | 3.3 | 8.7 | 105 | 73 | 5.0 |
| 18-2 | 3.0% HCHO | 5.8 | 3.1 | 7.6 | 77 | 70 | 8.8 |

Note:
Trimethylol melamine and methylated methylol melamine reacted with MPDA to form a precipitate in the bath. However, flannel treated with the filtered bath containing trimethylol melamine had a 71% reflectance and a 2.7 inch char length.
[a]Dimethylol methyl carbamate.
[b]Dimethylol ethylene urea.
[c]N-hydroxymethyl-3-dimethylphosphorus propionamide

EXAMPLE 13

Laundering durability of MPDA treatment on flannel

Cotton flannel was treated at 125% wet pickup with MPDA solution which had been neutralized to pH 10.4 (by adding 0.9 equivalents of NaOH for each equivalent of $NH_4Cl$ present) in the manner shown in Example 11. The fabric was dried, cured at 350° F., and then laundered fifty times to evaluate the durability of the flame retardant finish. Laundering tests were done with Cambridge city water at 43 ppm hardness and 120° F. We used only 30 grams of AATCC detergent for these launderings in soft water. Results are tabulated below:

| Expt. No. | MPDA Applied % owf | Min. at 350° F. | Laundered % Add-on Wt. | P | N | % P Yield | "Cl, Washed Once | 50× |
|---|---|---|---|---|---|---|---|---|
| 36-1 | 8.0 | 2 | 9.5 | 2.6 | 0.4 | 67 | 3.3 | 8.8 |
| 42-1 | 15.0 | 2 | 9.3 | 3.4 | 0.4 | 73 | 2.4 | 4.2 |
| | 15.0 | 1.75 | — | 3.2 | — | 69 | 3.1 | 5.8 |

Replicates of 42-1 were also laundered up to 50 times with AATCC detergent and the fabric properties determined after 10, 25, and 50 launderings for comparison with those of untreated flannel similarly laundered. Results were as follows:

| Expt. No. | Wash No. | Percent on Fabric P | N | Ca | Avg. "CL | ° WR W+F | Thread Count W/F | Strength % Fill/Retention Tear | Tensile |
|---|---|---|---|---|---|---|---|---|---|
| 42-1 | 1 | 3.4 | 0.4 | 0.3 | 2.4 | 211 | 45/45 | 63 | 64 |
| 42-2 | 10 | 3.0 | 0.4 | 0.5 | 3.1 | 199 | 45/44 | 69 | 54 |
| 42-3 | 25 | 3.1 | 0.5 | 0.5 | 3.4 | 189 | 45/45 | 67 | 55 |
| 42-4 | 50 | 3.2 | 0.5 | 0.4 | 4.2 | 161 | 44/44 | 56 | 56 |

Although the FF 3-71 laundering procedure does not specify the hardness of the wash water, many investigators have worked with hard water (145–155 ppm) to show the effect of calcium deposition on flame resistance. We, therefore, also evaluated the effect of laundering with water brought to 150 ppm hardness by the addition of a calcium chloride and magnesium chloride concentrate with a 3/1 Ca/Mg ratio. The water temperature was raised to 140° F., the quantity of detergent was increased to 90 grams, a 4-lb. dummy load was used, and the fabrics were tumbled-dried between launderings. The rinse water was Cambridge city water at 43 ppm hardness. Replicate flannelette samples treated with MPDA as before (42-1), when laundered in this manner, gave the following results:

| Expt. No. | MPDA Applied % owf | Wash No. | Min. at 350° F | Percent on Fabric P | N | Ca | % P Yield | "Cl 1 | 2 | 3 | 4 | Avg |
|---|---|---|---|---|---|---|---|---|---|---|---|---|
| 32-3 | 23.5 | 1 | 2 | 3.7 | 1.0 | — | 53 | 1.3 | 1.7 | 2.2 | 2.7 | 2.0 |
| | 23.5 | 25 | 2 | — | — | — | — | 3.3 | 3.5 | 4.0 | 4.5 | 3.8 |
| | 23.5 | 50 | 2 | 3.5 | 0.3 | 1.0 | — | 2.3 | 2.4 | 2.7 | 3.0 | 2.6 |
| | 18 | 1 | 2 | 3.7 | — | — | 66 | — | — | — | — | 2.8 |
| | 18 | 50 | 2 | — | — | — | — | — | — | — | — | 3.2 |

It is evident that the durability of the flame retardant finish obtained from insolubilization of MPDA is excellent even when this harsh laundering procedure is used.

EXAMPLE 14

Methylphosphonic di(methylamide) (MPDMA)

$$CH_3\overset{\overset{\displaystyle O}{\|}}{P}(NHCH_3)_2$$

MPDMA was synthesized by adding methylphosphonic dichloride (MPDC) in ether to an excess of methylamine in ether at −40° C. The sticky mixed products, MPDMA and methylamine hydrochloride, were dissolved in water (pH 5.0) and a 10% MPDMA solution was applied to 8 ox. cotton twill with the following results:

| Expt. No. | Min. at 350° F. | Percent on Laundered Twill Wt. | P | N | Ca | "CL | | | |
|---|---|---|---|---|---|---|---|---|---|
| 68-2 | 2 | 3.8 | — | — | — | — | — | — | — |
| 68-1 | 2 | 7.8 | 1.8 | 0.1 | 0.2 | 4.8 | 5.0 | 6.0 | 10.0 |

While MPDMA is less reactive than MPDA, the results obtained in this experiment shown that insolubilization of phosphorus can be attained if curing time is extended to three minutes, and flame resistance is then adequate.

EXAMPLE 15

Methylphosphonicthioic diamide (MPTDA)

$$CH_3\overset{\overset{\displaystyle S}{\|}}{P}(NH_2)_2$$

This compound (MPTDA) was prepared to compare the effectiveness of the thioamide with that of the amide (MPDA) evaluated previously (EXAMPLE 11). Also, since MPTDA can be more easily purified than MPDA, the experiment served to compare the application of purified reagent with that of crude compounds previously used.

MPTDA was prepared by slowly adding a solution of one mole (149 g; 105 ml) of methylphosphonothioic dichloride in 1 lb. anhydrous ether to a stirred solution of a large excess of ammonia (8–16 moles) in 2 lbs. anhydrous ether at −40° C:

$$CH_3\overset{\overset{\displaystyle S}{\|}}{P}Cl_2 + 4\ NH_3 \longrightarrow CH_3\overset{\overset{\displaystyle S}{\|}}{P}(NH_2)_2 + 2NH_4Cl$$

The thioamide could be separated from the ammonium chloride by-product by dissolving 154 g. crude solids in 270 ml. water at 46° C. and recrystallizing at 0° C. to obtain 48 g. (62% theory) of solid, mp 106°–8° C. An analytical sample (mp 108°–9° C.) had the following values (%) for elemental analysis:

| MPTD | C | H | P | N | S |
|---|---|---|---|---|---|
| Found | 10.8 | 6.58 | 28.0 | 25.3 | 29.0 |
| Theory | 10.9 | 6.36 | 28.2 | 25.4 | 29.1 |

Twill (8 os. cotton) was padded with a 15% solution of MPTD (MP 106°–8° C.) at pH 5.5 to a 90% wet pickup, dried at 220° F./5 minutes, and cured at 350° F./2–4 minutes. The cured fabric was discolored and a strong garlic odor was generated on washing in neutral or alkaline water. The laundered fabric was still discolored and smelled of hydrogen sulfide. The odor could not be removed by airing, and it was still apparent on fabric soaked overnight in 1.5% hydrogen peroxide at pH 8.5.

The laundered fabric properties were as follows:

| Expt. No. | Bath pH | Min. at 350° F. | Percent on Laundered Twill Wt. | P | N | S | % P Yield | "CL | | | |
|---|---|---|---|---|---|---|---|---|---|---|---|
| 78-3 | 6.5 | 2.0 | 6.2 | — | — | — | — | BEL | BEL | BEL | BEL |
| 78-4 | 6.5 | 2.5 | 6.3 | — | — | — | — | 5.4 | BEL | BEL | BEL |
| 78-5 | 6.5 | 3.5 | 7.5 | 1.8 | 0.3 | 0.2 | 48 | 1.6 | 3.2 | 5.4 | 8.6 |
| 78-2 | 5.5 | 4.0 | 7.2 | 2.1 | 0.3 | 1.0 | 57 | 2.4 | 2.6 | 2.8 | 3.0 |

These data show that the thioamide is less reactive than the MPDA evaluated in Example 11, and longer curing times are needed for insolubilization of phosphorus. It is not known whether the difference is inherent in the structures or partly due to the different level of purity (absence of inorganic salts in the case of the thioamide).

EXAMPLE 16

Bis-aziridinyl Methyl Phosphine Oxide (BAMPO)

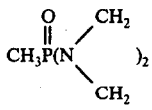

The effectiveness of this compound was compared with that of the corresponding chloromethyl compound as follows:

Following Chabrier et al., Compt. Rendn. Soc. Biol. 158, 2057–2059, (1964), a solution of one mole of methylphosphonic dichloride in 500 ml. of dry benzene was added dropwise to a stirred solution of 2 moles of ethyleneimine and 2.2 moles of triethylamine in 500 ml. of dry benzene at 10° C. The reaction stood at 25° C. overnight and was filtered. The solid TEA.HCl was stirred in 1 liter of benzene and again filtered off. The combined filtrates were concentrated by distilling-off the benzene and excess TEA at 30° C. under vacuum to 0.1 mm. to obtain 95 grams of BAMPO crystals, mp 26°–28° C. (Lit. mp 28° C.).

Testfabrics S/423 white twill was padded in a solution of 11.5% BAMPO and 1% monoammonium phosphate to an 85% wet pickup. It was dried at 105° C. for 5 minutes and cured at 350° F. for 1 or 2 minutes and laundered. Its properties compared favorably with data previously reported for twill treated with BACPO (bis-aziridinyl chloromethyl phosphine oxide) (Tex. Chem. & Colorists 6, 148–152 (1974)) after one laundering as shown in the table below:

COMPARISON OF BAMPO WITH BACPO ON 8 OZ. COTTON TWILL

| BAMPO Expt. | Min. at 350° F. | Wt. % Yield | Wt. % Add-on | Analyses %P | %N | "CL |
|---|---|---|---|---|---|---|
| 26-4 | 1 | 91 | 8.7 | 1.66 | 1.3 | 0.8 |
| 26-5 | 2 | 100 | 9.6 | — | — | 0.8 |
| BACPO Expt. | | | | | | |
| 8-1 | 3 | 82 | 8.9 | — | — | 6.5 |
| 8-2 | 5 | 85 | 9.3 | 1.63 | 1.2 | 2.8 |
| 8-3 | 10 | 90 | 9.8 | — | — | 2.8 |

Twill (8 oz. cotton) treated with BAMPO to an 8.7% add-on (26-4) was laundered 50 times and the char lengths were 1.3; 3.2; 4.6; and 7.3 inches.

E. Amidates

EXAMPLE 17

Methyl methylphosphono amidate (MMPA)

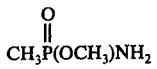

Methyl methylphosphono chloridate (17 grams) was prepared as described in Example 8, dissolved in 1 pint of chloroform, cooled to −78° C. with dry ice, and stirred while 50 ml. of liquid ammonia was added dropwise. The mixture stood at 25° C. overnight and the solid ammonium chloride was filtered off. The filtrate was evaporated to obtain 22 grams of solid (mp 42°–46° C.), methyl methylphosphono amidate:

| Percent | C | H | P | N |
|---|---|---|---|---|
| Theory for MMPA | 22.0 | 7.34 | 28.4 | 12.7 |
| Found | 21.9 | 7.55 | 28.4 | 12.6 |

A 15% solution of this product was applied to twill with 10% $N_2H_4$. HCl added as catalyst with the following results:

| Expt. No. | Min. at 350° F. | Laundered Once % Add-on | % Yield | "CL |
|---|---|---|---|---|
| 7-11 | 2 | 4.6 | 38 | BEL |
| 145-2 | 3 | 9.7 | 76 | 1.5 |

EXAMPLE 18

Methyl chloromethylphosphono amidate (MCMPA)

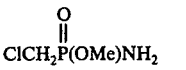

Reports of the methyl chloromethylphosphono cloridate could not be found in the literature, although ethyl chloromethylphosphono chloridate has been reported, Hudson et al, J. Chem. Soc. 1043 (1964). We attempted to make the methyl chloridate by an analogous procedure, adding a solution of one mole of anhydrous methanol in one mole of triethylamine to one mole of CMPDC in 1 L. of ether at 0° C., dropwise with stirring. The reaction stood at 0° C. overnight and the solid TEA.HCl was separated by vacuum filtration. In distillation of the filtrate, a fraction believed to be the desired product distilled at 60°/2 mm. in 5% yield, leaving a viscous residue in the still pot. The distilled chloridate was added dropwise to an excess of liquid ammonia at −30° C. with stirring and the residual ammonia was allowed to evaporate. The crude solid mixture was extracted with hot ethanol. The ethanol solution was evaporated under vacuum at 20° C. to yield a liquid. An aqueous solution of this liquid product was padded on twill, dried, cured at 320° F. for 15 minutes, and washed. The fabric contained 2.55% P, 1.66% Cl, and 0.93% N (an atom ratio of 1/0.6/0.8, respectively), and it had a 2-inch char length after this treatment, indicating that reaction with MCMPA had taken place.

EXAMPLE 19

Ethyl chloromethylphosphono amidate (ECMPA)

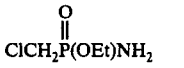

The ethyl chloridate (prepared as described in Example 7), was reacted with a large excess of liquid ammonia at −33° C. to form the amidate in 75% yield after recrystallization from carbon tetrachloride (mp 70°–71° C.; Lit. 71°–73° C.). The amidate was padded on twill and cured at 350° F. for 15 minutes.

Twill (8 oz. cotton) with a 7% add-on (17% yield) had a 45° AFT; with a 13% add-on (27% yield), the char length was 2.4 inches.

We claim:

1. The compound having the following formula

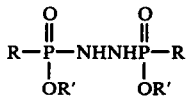

where R is an alkyl or a halogen-substituted alkyl having from 1 to 4 carbon atoms, and R′ is an alkyl or halogen-substituted alkyl having from 1 to 4 carbon atoms.

2. The compound having the following formula

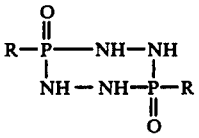

where R is an alkyl or a halogen-substituted alkyl having from 1 to 4 carbon atoms.

3. A cellulosic textile product containing affixed thereon about 5% to 15% by weight of the compound having the following formula

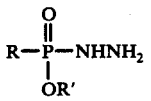

where R is an alkyl or halogen-substituted alkyl of from 1 to 4 carbon atoms, and R′ is an alkyl or a halogen-substituted alkyl of from 1 to 4 carbon atoms.

4. A cellulosic textile product containing affixed thereon about 5% to 15% by weight of the compound having the following formula

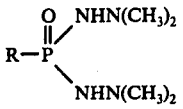

where R is an alkyl or halogen-substituted alkyl of from 1 to 4 carbon atoms.

5. A cellulosic textile product containing from about 5% to 15% by weight of the compound defined in claim 1 affixed thereon.

6. A cellulosic textile product containing from about 5% to 15% by weight of the compound defined in claim 2 affixed thereon.

7. A cellulosic textile product containing affixed thereon from about 5% to 15% by weight of the compound having the following formula

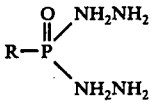

where R is an alkyl or halogen-substituted alkyl of from 1 to 4 carbon atoms.

* * * * *